US005217630A

United States Patent [19]

Sayles

[11] Patent Number: 5,217,630

[45] Date of Patent: Jun. 8, 1993

[54] APPARATUS FOR FORMING AN IRREGULAR SURFACE BLOCK

[76] Inventor: Jerome D. Sayles, 4780 Pinecrest Dr., Nashotah, Wis. 53058

[21] Appl. No.: 799,568

[22] Filed: Nov. 27, 1991

Related U.S. Application Data

[62] Division of Ser. No. 531,502, May 31, 1990, Pat. No. 5,078,940.

[51] Int. Cl.[5] ..... B28B 1/48; B28B 7/10

[52] U.S. Cl. ..... 249/52; 249/114.1; 249/140; 249/142; 249/161; 425/443

[58] Field of Search ..... 425/436 R, 441, 443; 249/52, 55, 63, 64, 66.1, 77, 114.1, 140, 142, 160, 161

[56] References Cited

U.S. PATENT DOCUMENTS

| | | |
|---|---|---|
| 374,118 | 11/1887 | Dobbs . |
| 379,429 | 3/1888 | Werth . |
| 415,773 | 11/1889 | Fiske . |
| 433,785 | 8/1890 | Harding . |
| 511,098 | 12/1893 | Shultz . |
| 787,199 | 4/1905 | Lloyd . |
| 803,014 | 10/1905 | McIlravy . |
| 819,055 | 5/1906 | Fisher . |
| 824,235 | 6/1906 | Damon . |
| 1,086,975 | 2/1914 | Aaronson . |
| 1,166,312 | 12/1915 | Barten . |
| 1,263,194 | 4/1918 | Blake . |
| 1,323,512 | 12/1919 | Whitacre . |
| 1,372,861 | 3/1921 | Birdsey . |
| 1,416,691 | 5/1922 | Crozier . |
| 1,517,128 | 11/1924 | Robertson . |
| 1,523,710 | 1/1925 | Pfeiffer . |
| 1,534,353 | 4/1925 | Besser . |
| 1,583,921 | 5/1926 | Garber . |
| 1,872,522 | 8/1932 | Stuckey . |
| 1,893,430 | 1/1933 | McKenzie . |
| 2,957,278 | 7/1956 | Woodworth . |
| 3,940,229 | 2/1976 | Hutton . |
| 3,981,953 | 9/1976 | Haines . |
| 4,139,593 | 2/1979 | Holz . |
| 4,335,549 | 6/1982 | Dean . |
| 4,516,364 | 5/1985 | Heider . |
| 4,738,059 | 4/1988 | Dean . |
| 4,869,660 | 9/1989 | Ruckstuhl . |

FOREIGN PATENT DOCUMENTS

| | | |
|---|---|---|
| 187032 | 10/1956 | Austria . |
| 204751 | 8/1959 | Austria . |
| 79016 | 5/1950 | Czechoslovakia . |
| 817950 | 1/1953 | Fed. Rep. of Germany . |
| 2416764 | 10/1974 | Fed. Rep. of Germany . |
| 2717176 | 10/1978 | Fed. Rep. of Germany . |
| 1036508 | 9/1953 | France . |
| 477661 | 7/1953 | Italy . |
| 278210 | 1/1952 | Switzerland . |
| 368290 | 5/1963 | Switzerland . |
| 456902 | 7/1968 | Switzerland . |
| 11582 | 7/1980 | United Kingdom . |

*Primary Examiner*—Jay H. Woo
*Assistant Examiner*—James P. Mackey
*Attorney, Agent, or Firm*—Andrus, Sceales, Starke & Sawall

[57] ABSTRACT

Concrete blocks are formed in a mold having a cavity into which block-forming material is placed. A portion of the material is retained in place relative to the cavity walls when the block is removed from the cavity, and the face of the block forming material adjacent a surface of the material retained in place is provided with a split-type appearance to its surface. A block having a rough surface closely resembling a split surface can thus be attained without the expense and time involved in conventional block splitting. The assembly can be constructed to form blocks having non-planar split-type surfaces. Additionally, split-type surfaces can be formed on an interior surface of a composite block module adapted for splitting along a splitting plane, to attain a block providing a split-type appearance along two spaced planes.

13 Claims, 2 Drawing Sheets

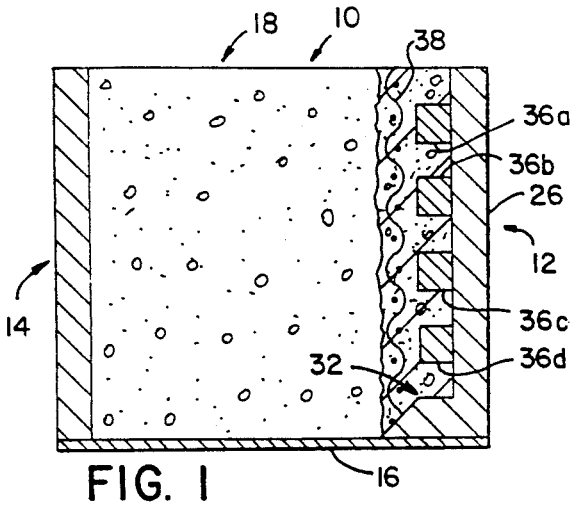
FIG. 1
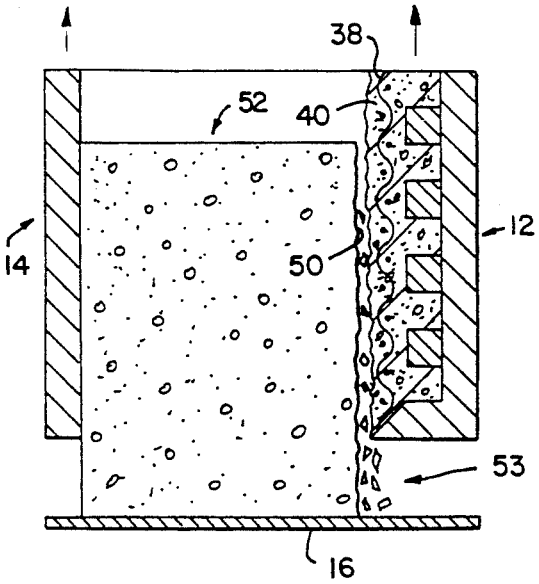
FIG. 2
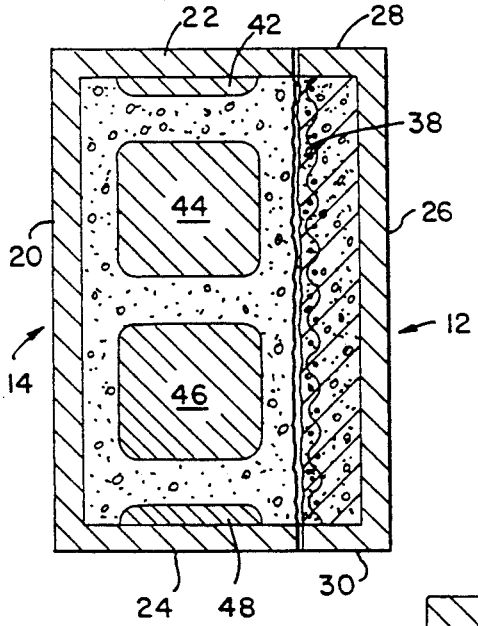
FIG. 3
FIG. 4
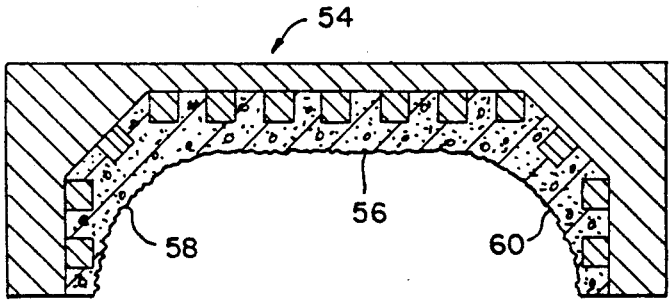
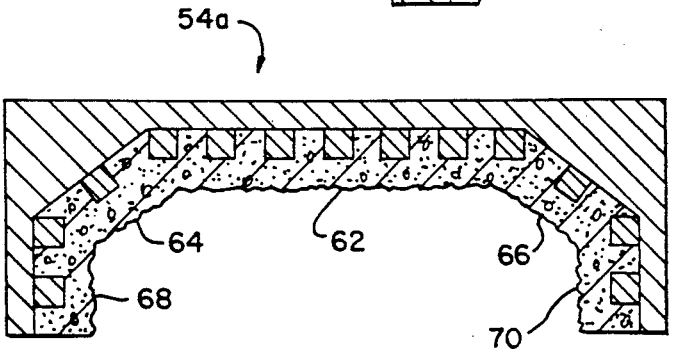
FIG. 5

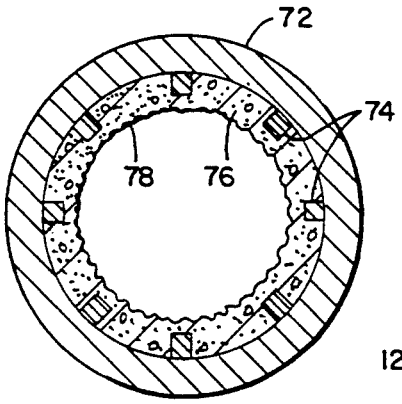
FIG. 6
FIG. 9
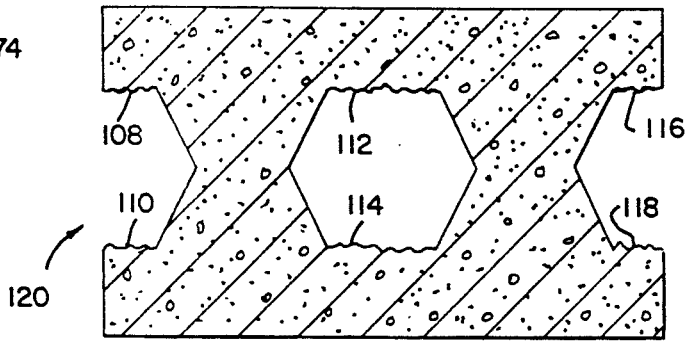
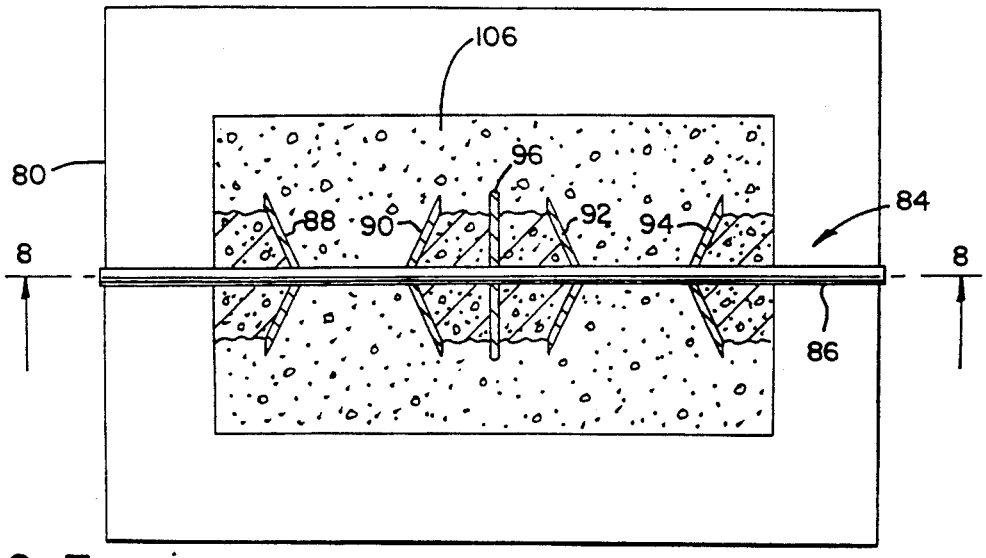
FIG. 7
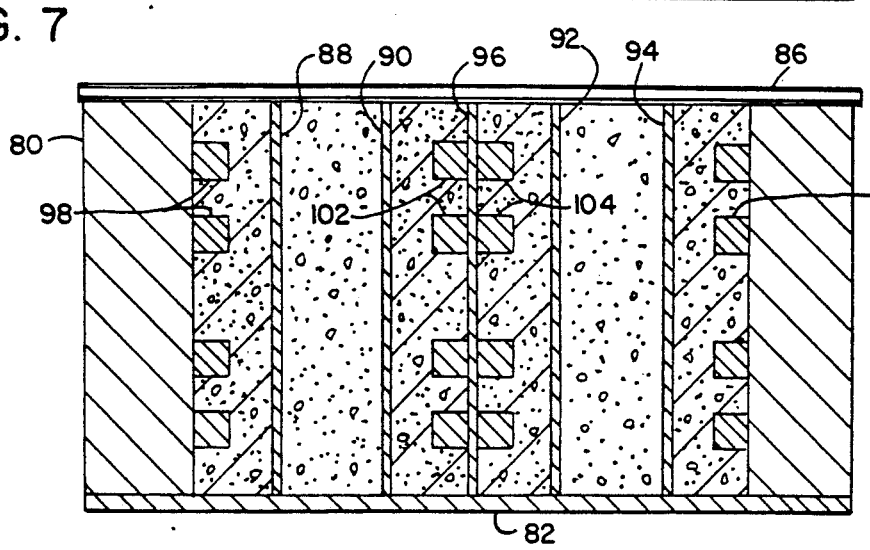
FIG. 8

APPARATUS FOR FORMING AN IRREGULAR SURFACE BLOCK

This is a division of application Ser. No. 07/531,502, filed May 31, 1990, now U.S. Pat. No. 5,078,940, issued Jan. 7, 1992.

BACKGROUND AND SUMMARY

This invention relates to an apparatus and method for forming a concrete block in which one or more surfaces of the block are irregular in appearance, providing a rough texture resembling that of a split block.

In the manufacture of concrete blocks, it is known to split a cured composite block module along one or more splitting planes to provide an irregular surface to the block. This procedure typically produces waste material from the splitting operation. The split appearance of the block surface is esthetically desirable in many applications. Splitting of blocks in this manner can take place only along a splitting plane, resulting in a substantially planar block face having an irregular surface at the split. This type of block forming is known in the art, and is generally acceptable for applications in which a planar split surface is desired.

In some applications, it is desirable to provide a block surface which is non-planar. In the past, it has not been possible to provide a non-planar split block surface, due to the limitations of block splitting technology.

Haines U.S. Pat. No. 3,981,953 shows a method of forming a fractured block face in which block material is placed into a mold cavity, with a grid-like series of elements being disposed within the cavity and suspended from a top plate. After the block material is compacted into the cavity, the sidewalls and top plate are drawn off the block formed by the material. Upward movement of the top plate lifts the grid-like series of elements, and the block material between the elements and the lower plate is broken off of the lower block material, leaving a fractured face thereon. A drawback to this arrangement is that the pattern of the elements is essentially cast into place in the block face.

The present invention is designed to address the above-noted problems, and to provide an apparatus and method for forming a block having an irregular split-type surface, in which the irregular or split-type surface need not be a planar surface. In addition, it is an object of the invention to provide a block forming apparatus and method which is capable of quickly and efficiently forming an irregular split-type block surface, either on an inside or an outside surface of the block.

In accordance with the invention, an apparatus for forming an irregular surface block comprises a cavity, a first portion of which is designed to retain therewithin block forming material providing an irregular surface, and a second portion of which is adapted to receive block forming material therewithin to form the block. The apparatus further comprises means for removing the block formed by the block forming material from the second portion of the cavity after the material has been in the cavity a short period of time, and before it begins to cure. In a preferred embodiment, a lower support plate is positioned below the portion of the cavity in which the block is formed, with the block forming material being placed above the support plate. Upon removal of the block from the cavity, the block forming material in the first portion of the cavity remains in place, forming an outer surface on the block having a split-type appearance.

In one embodiment of the apparatus, a split-type irregular surface is provided on an outer surface of the block. In this embodiment, the first and second portions of the cavity are defined by a bottom wall and one or more upstanding side walls. In a preferred form, the one or more upstanding side walls include a face plate assembly having a series or projections extending toward the cavity, with the face plate assembly defining the forward wall and lateral rearward extent of the first portion of the cavity. The projections on the face plate assembly act to retain the material within the first portion of the cavity. The cavity may be formed to any satisfactory shape as desired to define the shape of the irregular outer surface area of the block. A rectangular block can be provided with a single irregular outer face by constructing the face plate assembly so as to retain material within the first portion of the cavity to provide a single irregular surface facing the second portion of the cavity. Upon removal of the block from the second portion of the cavity, the irregular surface provided by the material retained in the first portion of the cavity provides the single irregular face to the block. Alternatively, an irregular surface can be formed to varying configurations as desired by varying the shape of the face plate assembly, and thereby the configuration of material retained within the first portion of the cavity. As yet another alternative, an irregular surface can be formed around the entire outer surface of the block by constructing the cavity so that material is retained within an outer portion of the cavity around the entire periphery of the cavity. The block is then formed in the interior portion of the cavity and, when removed from the cavity, the irregular surface provided by the material retained in the outer portion of the cavity forms an irregular surface on the entire outer surface area of the block. This feature of the invention allows a cylindrical block to be produced which has a split-type appearance on its entire exterior surface, providing a very unusual and desirable block. Other closed geometric-shaped blocks can be obtained in the same manner by constructing the cavity to provide the desired configuration.

In another embodiment of the invention, a split-type irregular surface is provided on an interior surface of the block. This embodiment is useful when forming a composite module from which a pair of split blocks are obtained. The module need only be split along a single splitting plane to provide the pair of blocks, but second surfaces having a split-type appearance along a different plane are obtained by the irregular surfaces which were formed on the interior surfaces of the module. In this embodiment, a core forming assembly is adapted to extend through the cavity, with the core forming assembly being provided with means to retain block forming material therewithin. Withdrawing the core forming assembly from the cavity provides the block forming material within the cavity with an irregular interior surface. The core forming assembly may be provided with spaced core areas across the width of the module, for providing a split-type appearance to an interior surface of the module at more than one location.

The invention further contemplates a method of forming a block, substantially in accordance with the foregoing description.

The block forming apparatus and method summarized above allows blocks having a split-type face to be produced quickly and efficiently, and with a minimum of waste block material.

BRIEF DESCRIPTION OF THE DRAWINGS

The drawings illustrate the best mode presently contemplated of carrying out the invention.

In the drawings:

FIG. 1 is a transverse sectional view of a block forming apparatus constructed according to the invention, with block material received therein;

FIG. 2 is a view similar to FIG. 1 showing relative movement between the side portions of the assembly and the lower support plate on which the block forming material is supported to remove the block from the apparatus;

FIG. 3 is a top plan view of the block forming assembly of FIGS. 1 and 2;

FIG. 4 is a partial top plan view of an alternative embodiment for the face plate assembly of the block forming assembly of FIGS. 1, 2 and 3, providing a non-linear front face to a block;

FIG. 5 is a view similar to FIG. 4, showing an alternative contour for the material retained within the face plate assembly, with the face plate assembly being similar in construction to that shown in FIG. 4;

FIG. 6 is a plan view of an alternative embodiment for the block forming assembly, showing an arrangement in which a split-type surface is provided about the entire outer surface area of the block, with the block being circular in cross section;

FIG. 7 is a top plan view of an alternative embodiment of the block forming assembly, showing a core forming assembly placed into the cavity in which the block forming material is received;

FIG. 8 is a sectional view taken generally along line 8—8 of FIG. 7; and FIG. 9 is a top plan view of a block formed using the block forming assembly with the core forming assembly of FIGS. 7 and 8.

DETAILED DESCRIPTION OF THE PREFERRED EMBODIMENT

Referring to FIG. 1, a block forming assembly 10 generally includes a face plate assembly 12, a rear portion 14, and a lower plate 16. In the position of block forming assembly 10 shown in FIG. 1, face plate assembly 12, rear portion 14 and lower plate 16 cooperate to form a cavity, which is adapted to receive therewithin a block forming material, shown generally at 18. Material 18 is a standard block mix of sand, cement, mortar and water, as is known in the block forming art.

Referring to FIG. 3, rear portion 14 includes a rear wall 20 and a pair of forwardly extending sidewalls 22, 24. Face plate assembly 12 generally includes a front wall 26 and a pair of rearwardly extending sidewalls 28, 30. Referring again to FIG. 1, face plate assembly 12 further includes a rearwardly extending lower wall or lip shown generally at 32.

Front wall 26 of face plate assembly 12, in combination with rearwardly extending sidewalls 28, 30 and lower wall 32, defines an upwardly and rearwardly open volume defining a first portion of the cavity in which material 18 is received. A series of rearwardly facing projections, shown at 36*a*, 36*b*, 36*c* and 36*d*, are mounted to front wall 26 so as to extend into the first portion of the cavity, to retain material 18 therewithin.

A reinforcing mesh 38 is spaced from the rearwardmost surfaces of projections 36*a*–36*d* within the first portion of the cavity, to assist in retaining material 18 therewithin.

Referring to FIGS. 1 and 3, when block forming assembly 10 is in its position shown, block forming material 18 is initially placed and compacted into the cavity defined by walls 20, 22 and 24, walls 26, 28 and 30, and lower plate 16. A series of core-forming bars, such as shown at 42, 44, 46 and 48 extend throughout the height of the cavity above lower plate 16 for forming cores into the block, as is known. The block forming material 18 is allowed to set for approximately ten (10) seconds, and face plate assembly 12 and rear portion 14 of block forming assembly 10 are then moved upwardly off of lower plate 16, as shown in FIG. 2. When this occurs, the volume of material 18 contained within the first portion of the cavity defined by face plate assembly 12 remains in place therein, with the assistance of projections 36*a*–36*d* and reinforcing mesh 38. This action essentially "shears" or splits the material 18, providing an irregular split-type surface 50 to the block, shown at 52. Some fragmentation of material 18 occurs during this action at the splitting area, resulting in waste material shown generally at 53. When face plate assembly 12 and rear portion 14 are lifted an amount sufficient to clear the upper surface of the formed block 52, lower plate 16 is removed to carry block 52 to a curing area, where block 52 is allowed to cure and harden in accordance with known practices.

With the construction and operation as described, the portion of material 18 retained within face plate assembly 12 remains in place when assembly 10 is moved into position for forming a subsequent block. Additional block forming material such as 18 is placed into the cavity to completely fill the cavity. The material retained by face plate assembly 12 is reused repeatedly to form blocks such as 52 having a split-type appearance to their faces, without actually splitting the block 52 from a composite module or the like. This eliminates the expense and time involved in setting up a separate splitting station, resulting in lower costs of manufacture for blocks having the split-type appearance to their faces.

Additionally, as shown in FIGS. 4 and 5, a face plate assembly such as shown at 54 can be employed to provide a contoured front surface to the finished block in which the split-type appearance can be formed continuously along a non-planar surface. Referring to FIG. 4, the material retained within face plate assembly 54 is provided with a flat medial portion 56 and a pair of curved end portions 58 and 60, which corresponds to the contour of the lower wall of the face plate assembly. As shown in FIG. 5, a face plate assembly 54*a* having a similar appearance in plan view to assembly 54 can be utilized to provide the material with a flat medial surface 62, angled intermediate surfaces 64 and 66, and end surfaces 68 and 70 by providing the lower wall of face plate assembly 54*a* with such a contour. In this manner, a non-planar split-type appearance surface can be provided to the finally formed block.

FIG. 6 illustrates an application in which a split-type appearance can be provided to the entire exterior surface of a block. In FIG. 6, a substantially cylindrical face plate assembly 72 is provided with rearwardly extending projections 74. The material retained within the face plate assembly, denoted at 76, provides an irregular surface 78 facing inwardly throughout the entire interior area of face plate assembly 72. With this arrangement, a cylindrical block can be formed having a rough split-type appearance about its entire outer surface. This type of block can be used in applications such as construction of columns or pillars to provide a highly ornamental and unusual esthetic appearance resembling that of a split-type block.

FIGS. 7 and 8 illustrate an alternative embodiment of the invention. As shown, a mold box 80 rests on a lower plate 82. A core bar assembly, shown generally at 84, is adapted for placement into the interior of a cavity formed by mold box 80. Core bar assembly 84 includes an upper bar 86 resting on top of and connected to the upper end of mold box 80. A series of opposed generally V-shaped members, shown at 88, 90, 92 and 94 are connected at their upper ends to the underside of upper bar 86, extending downwardly into the cavity provided by mold box 80 throughout its height. A reinforcing member 96 is provided between members 90 and 92.

Referring to FIG. 8, a series of projections 98 are connected to the left interior wall provided by mold box 80, and a series of projections 100 are likewise provided on the right interior wall of mold box 80. Between members 90 and 92, a series of projections shown at 102, 104, are connected to reinforcing member 96.

Block forming material 106 is adapted for placement into the cavity of mold box 80 around and between members 88, 90, 92 and 94. After block forming material 106 is compacted adequately and allowed to set a short time, e.g. approximately ten (10) seconds, mold box 80 is lifted off of lower plate 82, resulting in withdrawal of core bar assembly 84 from material 106. Material between the leftwardly facing surface of member 88 and the left interior wall of mold box 80 around projections 98 remains in place, as described previously to provide split-type interior surfaces. In a similar manner, material remains in place between member 94 and the right interior wall of mold box 80, and between members 90 and 92 around projections 102, 104, to provide split-type interior surfaces. This material remains in place, and is reused to form a subsequent module.

The formed module, shown in FIG. 9 at 120 includes inwardly facing split-type appearance surfaces 108, 110, 112, 114, 116 and 118. The split-type appearance surfaces 108-118 are formed removal of core bar assembly 84 with material remaining in place, as described previously.

Members 88, 90 and 92, 94 cooperate to form narrowed areas to module 120 along a substantially central longitudinal axis therethrough, and module 120 is adapted to be split by conventional splitting technology along such a plane. With this arrangement, a final block shape can be attained which provides split surfaces along a pair of spaced planes, which otherwise is extremely difficult to achieve with conventional splitting technology.

Various alternatives and embodiments are contemplated as being within the scope of the following claims particularly pointing out and distinctly claiming the subject matter regarded as the invention.

I claim:

1. An apparatus for forming an irregular surface block, comprising:

structure defining a cavity;

a support member cooperating with said cavity defining structure to define a closed cavity adapted to receive block forming material therewithin, with said support member acting to support said block forming material thereabove;

means for causing substantially linear relative movement between said cavity defining structure and said support member for removing a block formed by said block forming material from said cavity; and means associated with said cavity defining structure for retaining a portion of said material in place within said cavity during said relative movement between said cavity defining structure and said support member, to provide a split surface to said block where the portion of said material retained in place is separated from the remainder of said material in said cavity, said split surface being oriented substantially parallel to the direction of relative movement between said cavity defining structure and said support member.

2. The apparatus of claim 1, wherein said cavity defining structure is formed by a first portion and a second portion, and wherein the portion of said material retained in place is disposed in said first portion of said cavity defining structure.

3. The apparatus of claim 2, further comprising a face plate assembly defining said first portion of said cavity defining structure.

4. The apparatus of claim 3, further comprising a series of projections extending from said face plate assembly toward said cavity to assist in retaining block forming material in place in said first portion of said cavity defining structure.

5. The apparatus of claim 4, wherein said face plate assembly defines a lower end, and further comprising a lower wall provided toward the lower end of said face plate assembly and extending toward said cavity to maintain said material in place in said first portion of said cavity defining structure.

6. The apparatus of claim 2, wherein said cavity defining structure includes one or more upstanding walls defining the first portion of said cavity defining structure, and wherein the portion of said material retained in place is located adjacent said one or more upstanding walls.

7. The apparatus of claim 6, wherein said one or more upstanding walls define a closed geometric shape, and wherein the portion of said material retained in place extends about substantially the entire extent of said one or more upstanding walls, so that substantially the entire outer periphery of said block is provided with an irregular surface.

8. The apparatus of claim 7, wherein the closed geometric shape defined by said one or more upstanding walls is substantially circular, whereby a substantially cylindrical block is formed by said apparatus.

9. The apparatus of claim 1, further comprising core forming means extending through said cavity for forming one or more cores in said block, and wherein said core forming means functions to retain the portion of said material in place.

10. The apparatus of claim 9, wherein said core forming means comprises a core forming assembly including means for retaining a core of said material in place to provide said block with a core having a pair of facing split surfaces formed by the core of said material retained in place by said core forming assembly.

11. The apparatus of claim 10, wherein said core forming assembly includes a pair of spaced members adapted to extend through said cavity and between which said material is retained.

12. The apparatus of claim 10, wherein said cavity defines spaced ends, and wherein said core forming assembly is substantially centrally located within said cavity, and further comprising a pair of end core forming assemblies adapted for placement one at either end of said cavity for forming a pair. of end cores in said block, and wherein each end core forming assembly is provided with means for retaining a core of said material in place.

13. The apparatus of claim 12, wherein said core forming assembly includes a pair of spaced members between which said material is retained, and each said end core forming assembly includes a forming member spaced from a wall of said cavity, with said material being retained between said forming member and said cavity wall, and wherein said end core forming assembly forming members and the spaced members of said core forming assembly cooperate to define a convergent area to said cavity therebetween, wherein said block is adapted to be split along a longitudinal splitting plane defined by the convergent areas of said cavity to form a pair of substantially symmetrical split blocks each having split surface areas along a plane defined by said longitudinally splitting plane and formed by the core retaining means associated with said core forming assembly and said end core forming assembly.

* * * * *